US007609153B2

(12) United States Patent
Hatakenaka

(10) Patent No.: US 7,609,153 B2
(45) Date of Patent: Oct. 27, 2009

(54) CONTROL APPARATUS, SECURITY-SUPPORTED DEVICE, POWER SOURCE CONTROL METHOD FOR SECURITY-SUPPORTED DEVICE AND PROGRAM

(75) Inventor: Akihiro Hatakenaka, Kanagawa (JP)

(73) Assignee: Fujitsu Limited, Kawasaki (JP)

( * ) Notice: Subject to any disclaimer, the term of this patent is extended or adjusted under 35 U.S.C. 154(b) by 715 days.

(21) Appl. No.: 11/268,450

(22) Filed: Nov. 8, 2005

(65) Prior Publication Data

US 2006/0087212 A1 Apr. 27, 2006

Related U.S. Application Data

(63) Continuation of application No. PCT/JP03/08612, filed on Jul. 7, 2003.

(51) Int. Cl.
*G08B 26/00* (2006.01)

(52) U.S. Cl. ..... 340/505; 340/10.34; 340/500; 340/310.01; 340/3.1; 340/538

(58) Field of Classification Search ..... 340/505, 340/515, 629, 693.1, 3.1, 3.5, 538, 538.15, 340/310.11, 288
See application file for complete search history.

(56) References Cited

U.S. PATENT DOCUMENTS

| | | | | |
|---|---|---|---|---|
| 4,418,333 | A * | 11/1983 | Schwarzbach et al. | 340/310.11 |
| 5,530,431 | A * | 6/1996 | Wingard | 340/310.11 |
| 6,005,476 | A * | 12/1999 | Valiulis | 340/310.11 |
| 6,301,674 | B1 * | 10/2001 | Saito et al. | 713/340 |
| 6,526,516 | B1 * | 2/2003 | Ishikawa et al. | 713/340 |
| 6,732,282 | B1 * | 5/2004 | Brelin | 713/300 |
| 2002/0011923 | A1 * | 1/2002 | Cunningham et al. | 340/310.01 |
| 2002/0116342 | A1 | 8/2002 | Hirano et al. | |

FOREIGN PATENT DOCUMENTS

| | | |
|---|---|---|
| JP | 03-154436 | 7/1991 |
| JP | 3-154436 A | 7/1991 |
| JP | 5-176374 | 7/1993 |
| JP | 06-300298 | 10/1994 |
| JP | 6-300298 | 10/1994 |
| JP | 6-300298 A | 10/1994 |
| JP | 2002-245235 | 8/2002 |
| JP | 2002-245235 A | 8/2002 |
| JP | 2002-305845 | 10/2002 |
| JP | 2002-305845 A | 10/2002 |
| JP | 2002-331913 | 11/2002 |
| JP | 2002-331913 A | 11/2002 |

OTHER PUBLICATIONS

International Search Report dated Oct. 21, 2003.
Notice of Reason for Rejection dated Nov. 11, 2008 in corresponding Japanese Patent Application No. 2005-503392 (8 pp including translation).

* cited by examiner

*Primary Examiner*—Eric M Blount
(74) *Attorney, Agent, or Firm*—Staas & Halsey LLP

(57) ABSTRACT

A control apparatus in a crime prevention system comprises a communication unit that notifies each managed apparatus that the application of power to that apparatus is to be managed; a registration unit that, in response to an answer to the notification from an apparatus, registers the apparatus as a managed apparatus to indicate that the application of power to the apparatus is to be managed; and a power control unit that controls whether to apply power to the apparatus based on information registered with the registration unit.

14 Claims, 9 Drawing Sheets

CONTROL APPARATUS, SECURITY-SUPPORTED DEVICE, POWER SOURCE CONTROL METHOD FOR SECURITY-SUPPORTED DEVICE AND PROGRAM

CROSS-REFERENCE TO RELATED APPLICATION

This is a continuation of Application PCT/JP2003/008612, filed on Jul. 7, 2003, now pending, the contents of which are herein wholly incorporated by reference.

BACKGROUND OF THE INVENTION

1. Technical Field

The present invention relates to a security system utilizing a network built up by using a power line.

2. Background Arts

Over the recent years, every type of device (e.g., an information device, a home electrical appliance, etc.) has been downsized. For example, as for the information devices, there is the spread of down sized versions of a desktop personal computer, a printer, a scanner, which have hitherto been used by installing these devices in fixed positions. Therefore, a convenient environment appears, wherein all types of information devices can be readily carried everywhere without being limited to the notebook type personal computer.

On the other hand, the downsized device is easy to carry and therefore has a great possibility of being stolen, and has a problem in terms of the security in its hands. A security solution as a countermeasure for the downsized device has hitherto been a method for safeguarding by locking the device by use of a security tool such as a chain lock. For others, the information device such as the personal computer takes a method of ensuring the security by use of, e.g., a smart card.

There arise, however, the following problems when adopting the methods described above. Specifically, the device is locked by employing the chain lock, the chain lock might be broken, and there is a case in which the device is easy to be carried out and might be abused intactly. Further, a drawback to ensuring the security by employing the smart card is time-consuming to the user. Namely, in the case of taking the countermeasure for the security using the smart card, the user needs operations of carrying the smart card, inserting the smart card into the device when used and obtaining authentication for using the device by inputting a password.

Moreover, as to the security system, there is a system (Patent document 1) in which a radio signal is transmitted from a broadcasting station in order to prevent, e.g., theft of a car. An assumption in this type of system, however, is a large-scale system based on a wireless base station etc., and hence a tremendous cost is required for building up and preparing an infrastructure including installation of the base station. This type of system is not suited to the system for controlling the downsized devices.

For others, technologies disclosed in Patent document 2 and Patent document 3 are given as technologies related to the present invention.

[Patent document 1]

Japanese Patent Application Publication No.2002-331913

[Patent document 2]

Japanese Patent Application Publication No.3-154436

[Patent document 3]

Japanese Patent Application Publication No.2002-245235

SUMMARY OF THE INVENTION

It is an object of the present invention, which solves the problems given above, to provide a security system utilizing power line carrier frequency communications. Namely, the present invention aims at providing a technology related to the security system on the assumption of a network that can be built up by making use of a power line led into each home.

The present invention takes the following configurations in order to solve the problems described above. Namely, the present invention is a control apparatus for providing a security system, comprising a communication unit notifying each of devices existing under control that the device is a control target device to be controlled as to power-on permissibility, a registration unit registering the device as the control target device to be controlled as to the power-on permissibility when accepting a response to the notification, and a power source control unit controlling the power-on permissibility of the control target device on the basis of information registered on the registration unit.

Preferably, the control apparatus may further comprise an input unit accepting a setting of the power-on permissibility of the device.

Preferably, the control apparatus may further comprise a group setting unit setting any one or more devices in any one or more control target device groups in a plurality of control target device groups, wherein the power source control unit may control the power-on permissibility for every control target device group with respect to the device set in each of the control target device groups.

Further, the present invention is a security system supported device comprising a setting unit setting as to whether or not the device itself is under control of a control apparatus on a network, a control unit querying the control apparatus about a state of registration of the device itself when the setting of being under the control is done by the setting unit, and a switch unit connecting a body unit of the device to a power source in a disconnectable manner, wherein the control unit may instruct the switch unit to conduct the power-on of the body unit of the device when a response to the query contains information indicating permission of the power-on.

Preferably, the control unit may be constructed so as not to instruct the switch unit to conduct the power-on of the body unit of the device when the control apparatus does not exist.

According to the present invention, the control apparatus can control the permissibility of the power-on of all the devices existing on the network (within a self-recognizable area).

Moreover, according to the present invention, the device is controlled by the control apparatus and can not be used because of being unable to switch ON the power source unless permitted by the control apparatus. Further, in the device, if the control apparatus does not exist on the network, the power-on of the body unit of the device is not conducted. Thus, the power-on of the device depends on the control apparatus, and hence, for instance, the user can prevent the power-on of all the devices existing on the network simply by pulling the plug of the control apparatus from the socket. Therefore, a security environment can be easily ensured without performing the time-consuming setting such as locking the devices one by one with chain locks etc. or inserting the smart card (into the device) as done by the prior arts.

On the other hand, if the device is carried out without permission, no permission is given from the control apparatus, so that the device can not be employed unless permitted.

As described above, according to the present invention, it is possible to provide the security system functioning on the network built up by utilizing the power line in linkage between the control apparatus and the devices.

Further, the present invention may also be a method by which the control apparatus or the device each executes any one of the processes described above. Still further, the present invention may also be a program making a computer actualize any one of the functions described above. Yet further, the present invention may also be a readable-by-computer recording medium recorded with such a program.

DETAILED DESCRIPTION OF THE INVENTION

Figure 1:
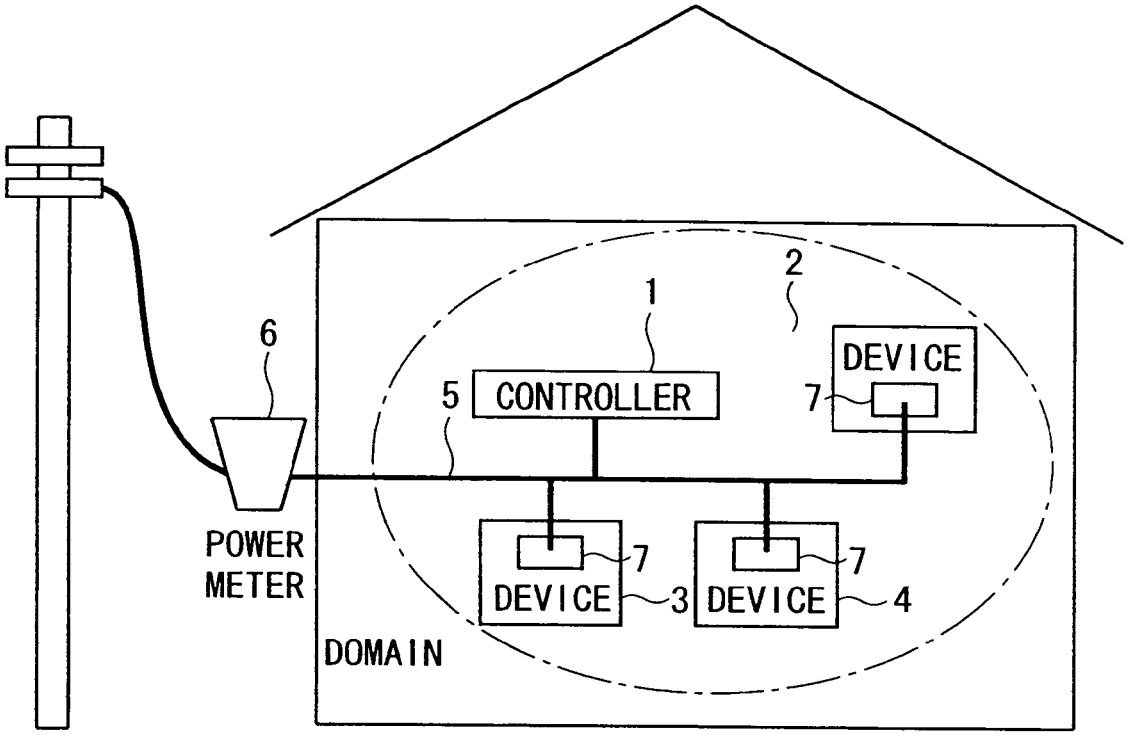
FIG. 1 is a view showing an outline of a system utilizing power line carrier frequency communications.

An embodiment of the present invention will hereinafter be described with reference to the drawings. It should be noted that the description of the present embodiment is an exemplification, and the configuration of the invention is not limited to the following explanation.

Embodiment

<Outline of Power Line Carrier Frequency Communications>

The present embodiment actualizes theft-prevention of a device connected to a power line by making the use of a network (which will hereinafter be called a "power line carrier frequency communication network") that can be configured by utilizing the power line (which is also called a lighting line) led into individual homes. Namely, an assumption of the present embodiment is a network closed within the home (in-home network) that can be configured by utilizing the power line carrier frequency communications. A typical infrastructure for performing the power line carrier frequency communications is the ECHONET (Energy Conservation and Homecare Network) Standard for controlling connections to mainly so-called white color home electrical appliances (typified by a refrigerator, an air-conditioner, a washing machine, a rice boiler, an electronic oven, etc.). The ECHONET Standard is the infrastructure for controlling the devices performing the communications at a speed that is as low as approximately 9600 kbps at the present by employing a frequency band equal to or lower than 450 KHz. The description of the present embodiment will be made on the assumption of the network that can be configured by utilizing the ECHONET Standard, however, the embodiment is not limited particularly to the ECHONET Standard. Namely, the present embodiment can be actualized if in an environment where the power line carrier frequency communications can be utilized (the in-home network can be configured by using the connections of plug sockets).

A network architecture configured by employing the ECHONET Standard is similar to a TCP/IP (Transmission Control Protocol/Internet Protocol) based network architecture at the present, and has addresses corresponding to a MAC (Media Access Control) address and an IP address. Namely, the network configured by utilizing the ECHONET Standard has a concept similar to a LAN (Local Area Network) environment built up on an IP basis, and its configuration is such that an address is assigned to a management target device, a unit of communications is segmented by a subnet, and the subnets are connected via a router. An aggregation of the subnets is handled based on a management unit named a domain, and this domain is an area that assures transmission of information. The connection to the outside is conducted normally via a gateway. A condition in the present embodiment may, however, be that the network area closed within the home is assured, and hence a concept of the gateway is not required. Namely, the assumption in the present embodiment is the network, wherein the devices belonging to the domain area can perform the communications with each other.

The present embodiment is not the invention related to an encrypted communication method and does not therefore touch the security in depth on a transmission route because of dependence on the platform. As a matter of course, however, it is desirable that the communications be encrypted by utilizing a general type of encryption communication protocol. The exemplification in the present embodiment is that an interface for connecting the device is an interface pursuant to ECHONET supported device adapter interface specifications defined as specifications for the power line carrier frequency communication environment serving as the infrastructure. Therefore, in an ECHONET communication layer configuration (layer stack), it follows that a difference between the protocols is absorbed by an ECHONET communication Middleware layer.

Further, also in the case of considering so-called authentication for identifying each individual device, needless to say, it is required for the higher security to utilize an existing encryption and authentication sequence in SSL (Secure Socket Layer) communications etc. . . . For example, when establishing the network connection on a physical layer, what is considered is not that the address assigned to each device is transferred and received as the address for the identification but that the address is encrypted with a common key through the SSL communications.

Based on what has been described so far, an outline of the security system utilizing the power line carrier frequency communications will be explained.

<Outline of Security System Utilizing Power Line Carrier Frequency Communications>

FIG. 1 is a view showing the outline of the system utilizing the power line carrier frequency communications. FIG. 1 shows an example, wherein the network utilizing the power line carrier frequency communications is configured by connecting a controller 1 controlling devices and these control target devices 2, 3 and 4 to a power line 5 led into a home via a power meter 6 by use of plug sockets. The thus configured network will hereinafter be called a power line network. FIG. 1 shows the example that a plurality of control target devices are connected, however, one single device may also be connected.

The controller 1 can be pre-registered with the respective control target devices, and is so constructed as to be capable of setting permission or non-permission of electrification (electric conduction) to the each device on the basis of a predetermined condition. For instance, if each of the devices is not in such an environment as to exist on the power line network (if a MAC address held by each device is not recognizable in the controller 1), the setting to be considered is that the electrification to each device is not permitted.

The devices 2, 3 and 4 can mutually transmit and receive signals. Each device is constructed to include a dedicated power source unit 7 having a built-in power line carrier frequency communication function. This power source unit 7 is constructed so that the unit 7 is neither removable nor replaceable from the device. The power source unit 7 undergoes setting such information that the unit 7 itself is a control target unit of the controller 1. Each device is assigned an identification ID corresponding to an IP address and is thereby managed. This identification ID is set, in the controller 1, together with the information showing the permission or non-permission of the electrification when installed for the first time. In each of the ID-set devices, at first only the power source unit 7 becomes an electrified state when plugging in the socket, and checks whether or not the controller exists on the power line network via the power line 5. Herein, if not set electrifiable when the controller does not exist on the power line network or even when existing, the power source unit 7 of the device performs a function of not electrifying the device body.

Thus, the present embodiment will give a description of the system capable of restricting the use of each device in a way that controls power-on of each device by employing the controller 1. Further, in the network in the present embodiment, a security environment can be built up limitedly to the area recognizable to the controller 1.

What has been discussed so far is based on the assumption of the security system utilizing the power line network configured within the home illustrated in FIG. 1. The embodiment of the present invention is not, however, limited to the power line network configured within the home. It is therefore considered to take the following configuration.

An available configuration is that not a single piece but plural pieces of controllers 1 are prepared and can be separately used corresponding to a using environment. For instance, the configuration may be, it is considered, such that the respective controllers 1 are pre-registered with the identifications IDs of the devices given permission of the use, and the usable device is changed over by replacing the controller 1 in accordance with the environment.

Moreover, another configuration may be such that the single controller 1 is registered with device combination patterns (combinations of the usable devices), and there is provided a function enabling the combination pattern to be changed over from on a menu screen. For example, when the devices A, B and C exist, a pattern 1 permits the use of the devices B and C, and a pattern 2 permits the use of all the devices A, B and C.

Figure 2:
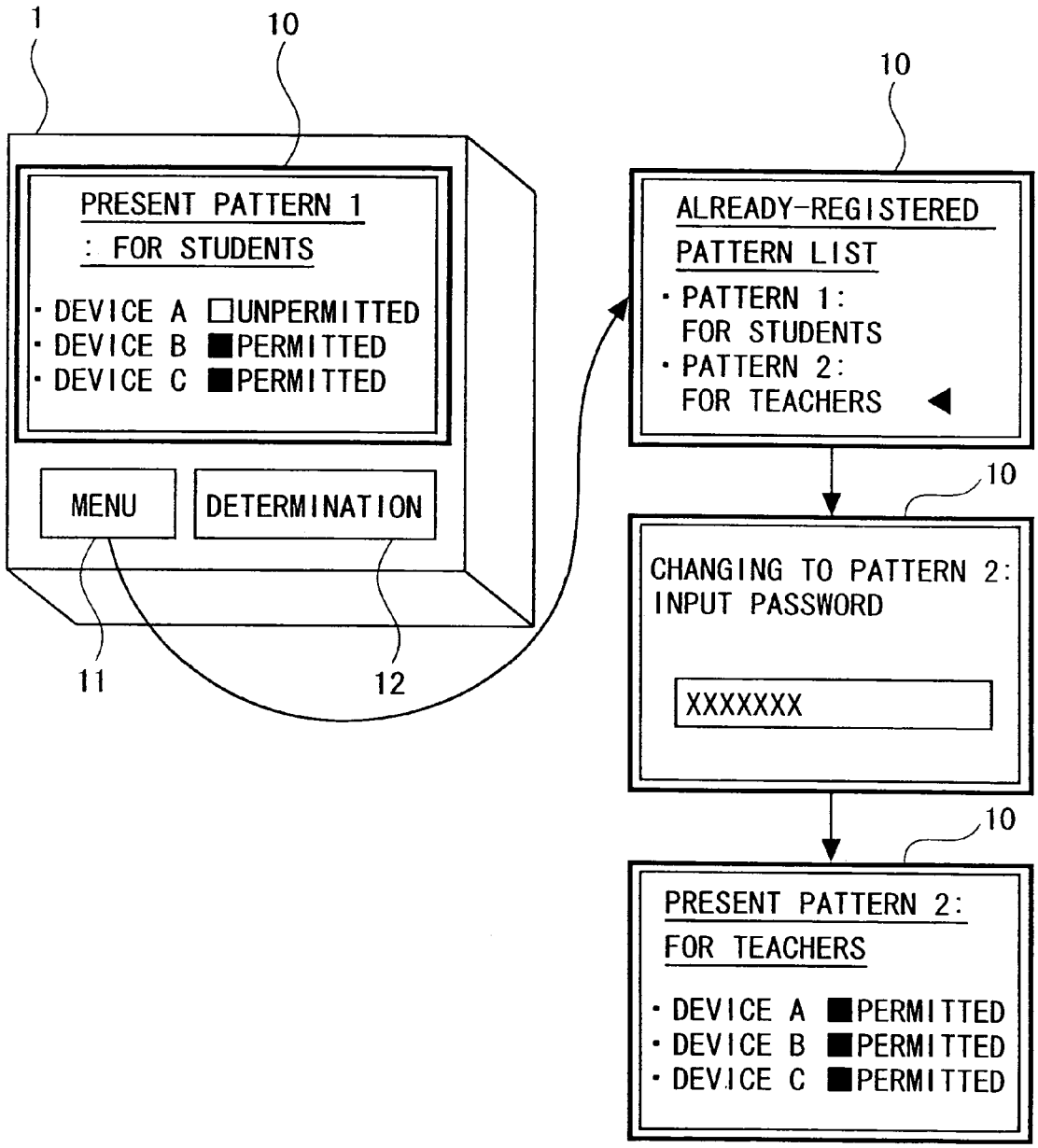
FIG. 2 is a diagram showing an example of screen layouts in a case where a controller has a pattern changeover function.

Thus, it is considered that the controller 1 is registered with the plurality of security patterns, and the user is prompted to select the pattern. FIG. 2 is a diagram showing an example of screen layouts in the case where the controller 1 has the pattern changeover function. FIG. 2 shows the example, wherein the present pattern is changed over to a pattern 2 (for teachers) from a pattern 1 (for students) on the basis of the pre-registered patterns. The present pattern showing the permission or non-permission of the electrification to the respective devices, is displayed on a display screen 10 of the controller 1. The changeover of this pattern involves such operations that a user, for example, invokes a registered pattern list with a menu button 11, then selects a want-to-change pattern from this pattern list and determines the selected pattern with a determination button 12. Still another configuration may be that a restriction such as having a password inputted when changing over the pattern is provided. Further, the unnecessary device is deleted from under the control of the controller 1, thus changing the already-registered patterns. By adopting the configuration provided with this type of function, the controller 1, even one single controller, can change over the usable devices corresponding to the using environment.

<Device>

Figure 3:
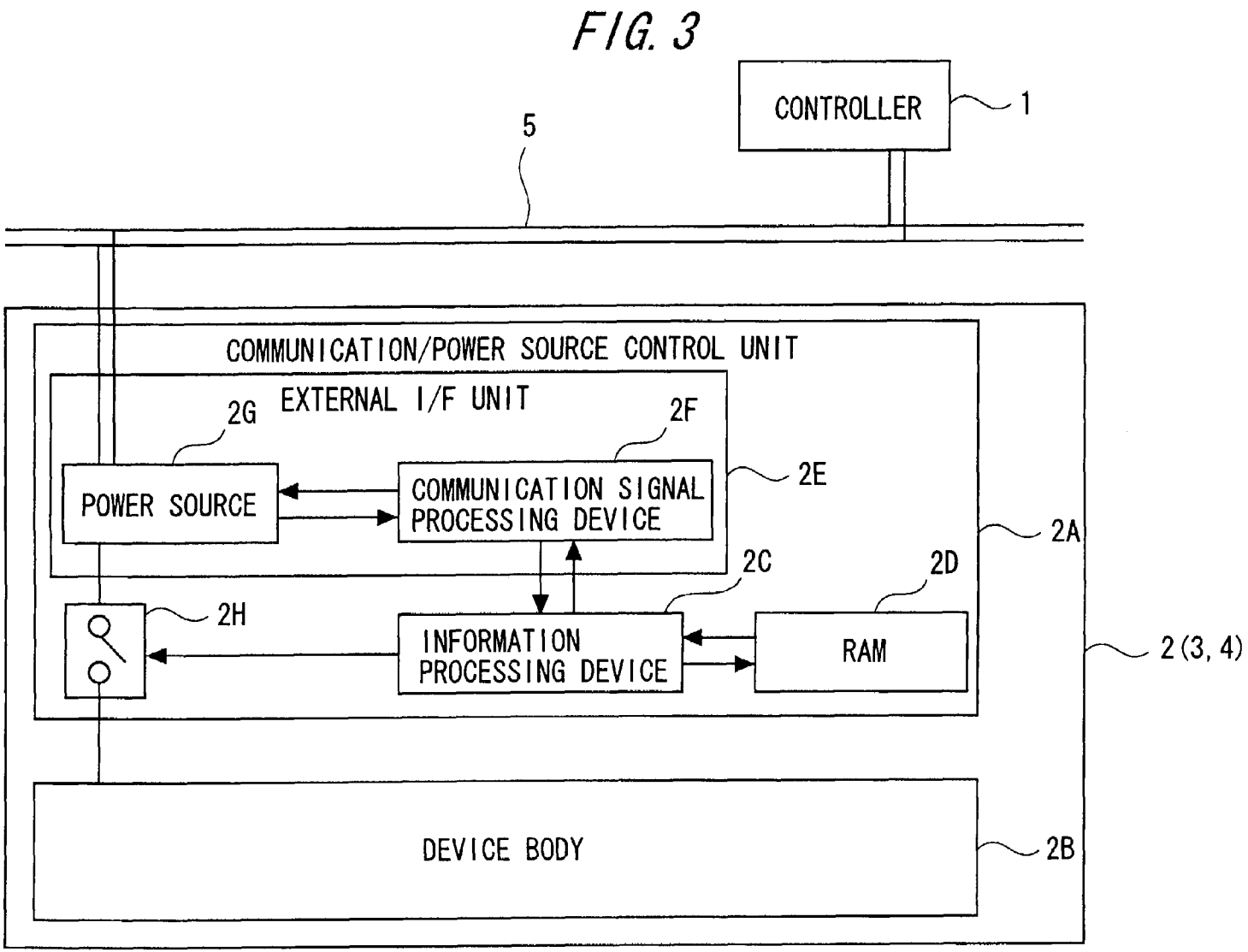
FIG. 3 is a diagram of a system configuration of a device in an embodiment for actualizing the present invention.

Next, a system configuration of the device 2 will be explained with reference to FIG. 3. FIG. 3 is a diagram of the system configuration of the device in the embodiment for actualizing the present invention. Herein, the description will be made by taking up the device 2, however, the devices 3 and 4 also have the similar system configuration. The device 2 is constructed of a communication/power source control unit 2A and a device body 2B. The communication/power source control unit 2A is constructed to include an information processing device 2C that controls respective functions and executes internal processes, a RAM 2D stored with information related to the processes, an external interface unit 2E, and a switch 2H controlling the electrification to the device body 2B. The external interface unit 2E has a power source 2G and a communication signal processing device 2F executing a series of processes related to the communications of the signals (information) transmitted and received across the network. Among these components, the RAM 2D may be constructed by using a general type of semiconductor memory or also a FRAM (Ferroelectric Random Access Memory).

The information processing device 2C receives the signals transmitted via the communication signal processing device 2F from the power line 5 and stores the RAM 2D with necessary pieces of information. Further, the information processing device 2C controls the switch 2H in the case of electrifying the device body 2B.

<Controller>

Figure 4:
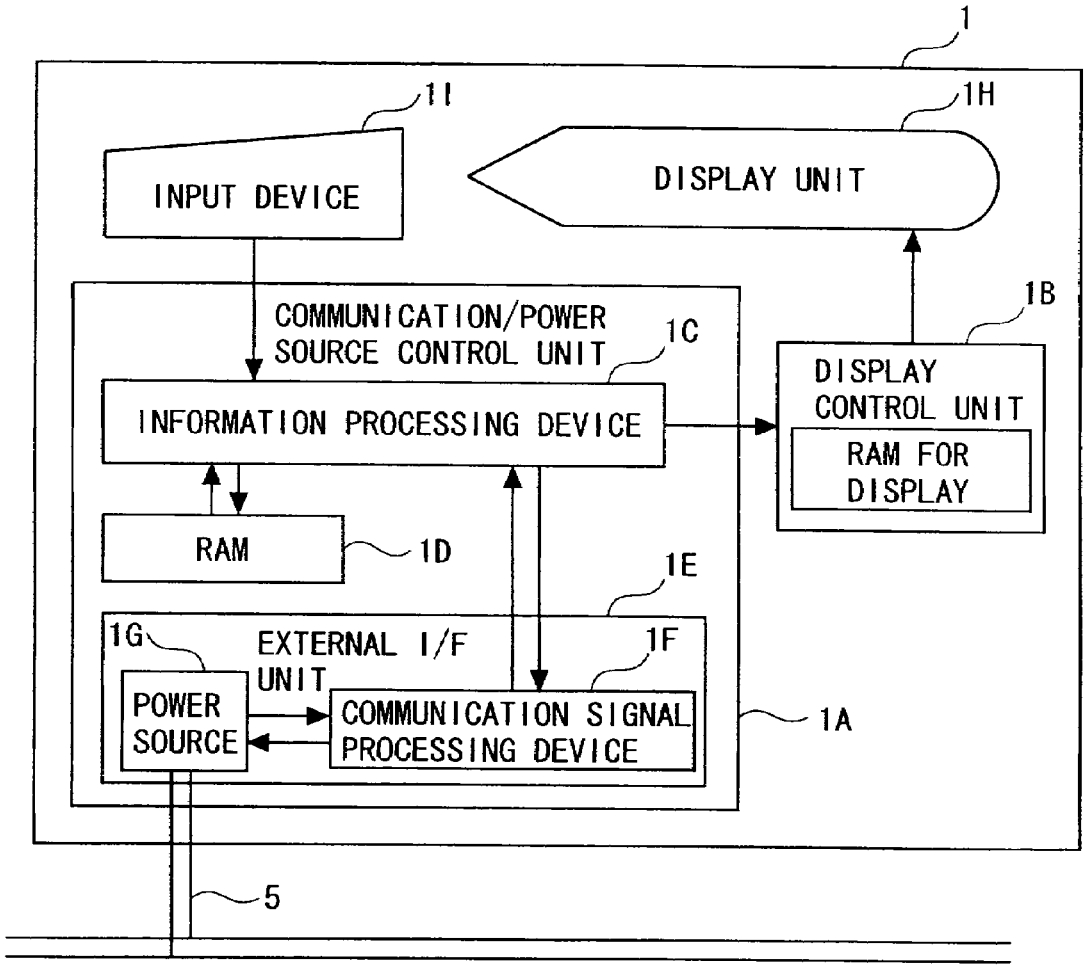
FIG. 4 is a diagram of a system configuration of the controller in the embodiment for actualizing the present invention.

Next, a system configuration of the controller 1 will be explained with reference to FIG. 4. FIG. 4 is a diagram of the system configuration of the controller in the embodiment for actualizing the present invention. The system configuration of the controller 1 is basically similar to the system configuration of the device 2, wherein the communication/power source control unit 1A has the same construction as the communication/power source control unit 2A has. The controller 1 is different from the device 2 in terms of having none of the control target device body and including a display control unit 1B controlling display on a display unit 1H, the display unit 1H displaying an input result and a menu, and an input device 1I that conducts inputting from the outside for selecting the menu and setting the password. The display control unit 1B has a display RAM that is accumulated with display data. The display unit 1H and the input device 1I function as a user interface on the occasion of performing the settings.

Figure 5:
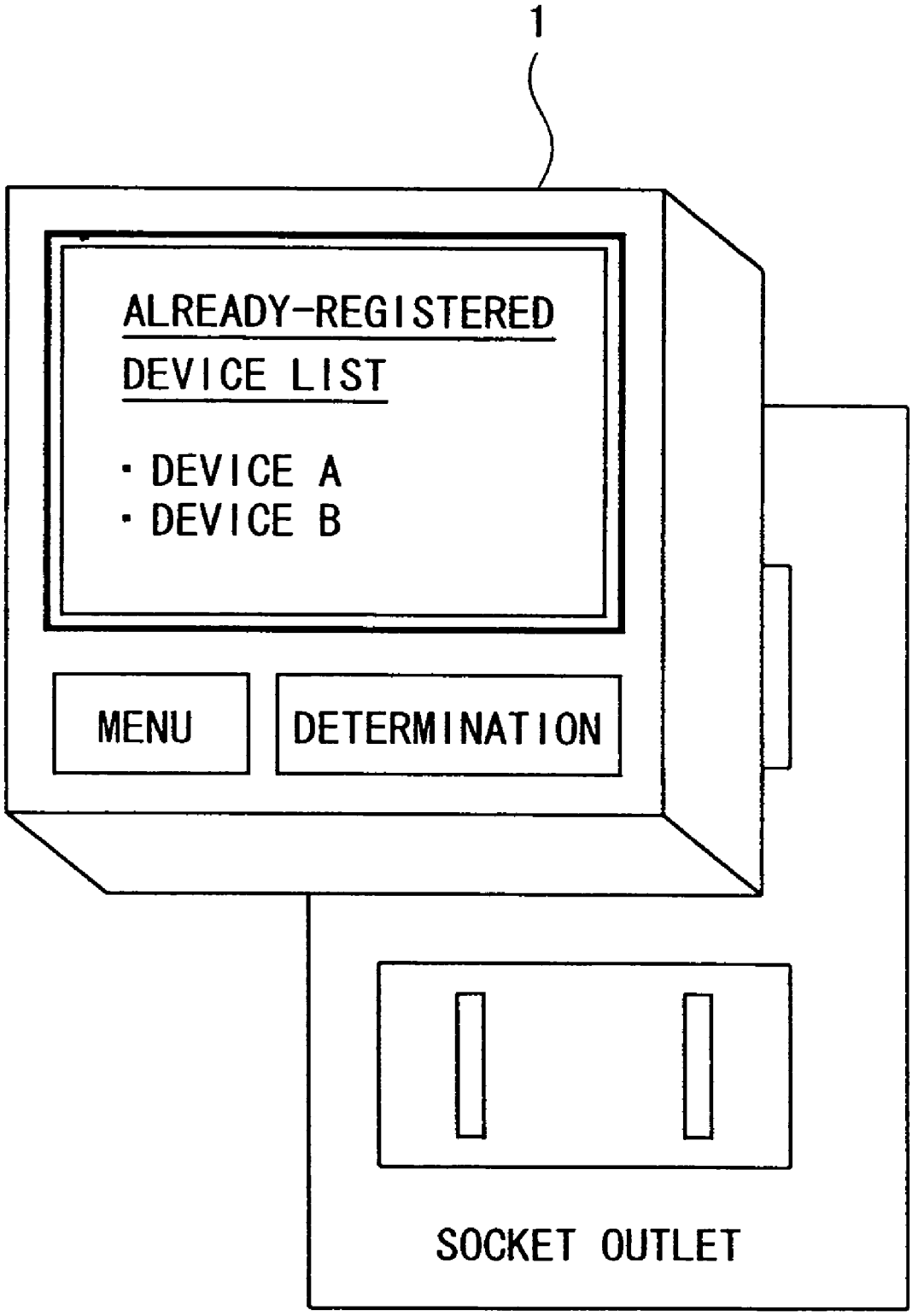
FIG. 5 is a diagram showing one example of an external configuration of the controller.

Next, an external configuration of the controller 1 will be explained with reference to FIG. 5. FIG. 5 is a diagram showing one example of the external configuration of the controller 1. The controller 1 is constructed to function simply by putting the plug into and pulling the plug out of the socket. Namely, the controller 1 takes the configuration enabling the control to hinder each device from operating by removal. With this configuration adopted, for instance, the user can disconnect the controller 1 from on the power line network simply by the operation of pulling the plug of the controller 1 from the socket when going out and so on, and each device is prevented from being used without permission. Accordingly, the controller 1 can be also utilized as a key for locking the operation of each device. Further, it is desirable that the controller 1 be constructed in a portable size. The present embodiment does not minutely touch a shape of the controller 1, however, a (business) card-sized communication board has already been utilized as a device for the power line carrier frequency communications at the present, so that it is technically well possible to configure the controller 1 in the portable size.

The controller 1 functions basically as the power source is immediately switched ON (power-on) at a point of time when plugging into the socket. Actually, a restriction as to whether the controller 1 can be used or not may be set by authenticating the password inputted from the input device 11. For instance, it is considered that the controller 1 is so constructed as to prompt the user to input the password when putting the plug into the socket. This configuration, if the controller 1 might be stolen, makes it possible to suppress an unauthorized use that abuses this controller 1.

Further, it is also considered that the controller 1 can be constructed as an embedded type within a socket in a wall or a key-locked type. Namely, each device does not operate without the controller 1, and hence there may be adopted the configuration that prevents the controller to be stolen. It is feasible by taking this configuration to suppress the theft of a set of the controller 1 and each device as in, e.g., a freely-accessible exhibition hall for outside persons. Therefore, even if the device might be stolen as a single unit, the unauthorized use thereof can be prevented.

<Operation>

Next, mainly an operation occurred in linkage between the controller 1 and the devices 2, 3 and 4 will be explained. Herein, the explanation will be made on the presumption that the individual devices have already been connected to the power line network, and only the communication/power source control unit 2A is in the electrified state.

The controller 1, when connected to the power line 5 through the socket, executes broadcasting to the respective devices existing on the power line network. Each of the devices receiving the broadcast sends, to the controller 1, notification containing the identification ID as a response informing of its existence. The controller 1 receiving the notification lists up all the devices existing on the network by use of the identification IDs contained in the respective pieces of notification, and displays the device list on the display unit 1H. The user selects a usage target (usage-permitted) device from the list displayed on the display unit 1H of the controller 1, and sets this selected device as the usage target device.

The controller 1 notifies each of the thus-set devices that the device itself has been set as the usage target device. Each device receiving the notification stores the RAM 2D with the information that the device itself has been set as the usage target device in the controller 1. Simultaneously, the device sends, to the controller 1, the notification informing that the setting of the controller 1 is permitted together with the identification ID.

The device, which has been once set as the usage target device by the controller 1, when started up next time, queries the controller 1 about whether the device itself is a usage-permitted device or not through the notification containing the identification ID. Herein, the device, if unable to confirm the controller 1 on the power line network, does not permit the power-on of its own device body 2B.

The controller 1 receiving the query judges from the set information stored on the RAM 1D whether the identification ID contained in the notification specifies the usage-permitted device or not. The controller 1 notifies, based on this judgment, the query-sender device of the permission or non-permission of the power-on.

The device executes, based on the notification given from the controller 1, judging whether to electrify the device body 2B or not.

Thus, the controller 1 can control as to whether the power-on of the device existing within the power line network is permitted or not.

<Processing Flow>

<<Controller>>

Figure 6:
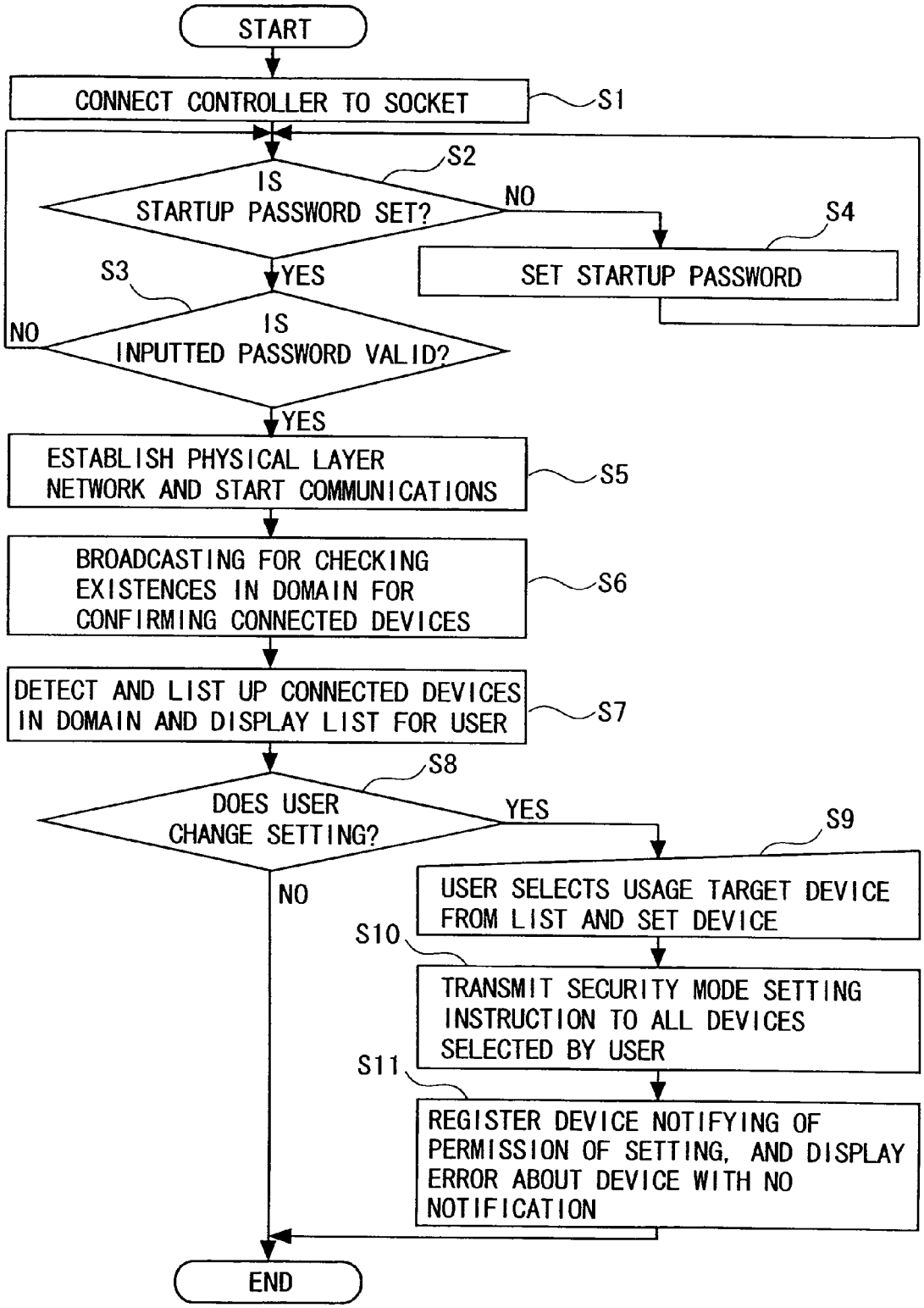
FIG. 6 is a flowchart showing a process in which the controller 1 registers each device as a usage target device.

Next, a process that the controller 1 registers each device as the usage target device, will be explained with reference to FIG. 6. FIG. 6 is a flowchart showing the process in which the controller 1 registers each device as the usage target device. Herein, the assumption is that the controller 1 is so constructed as to be usable by inputting the startup password. Note that the process executed by the controller 1 is actualized by, e.g., a control program on the information processing device 1C.

To begin with, the user connects the controller 1 to the plug socket (S1). Hereat, the power source 1G of the controller 1 is connected to the power line 5, whereby the controller 1 comes to the electrified state.

The controller 1 judges whether the startup password has already been set on the RAM 1D or not (S2). If the start up password has been set, the controller 1 prompts the user to input the password. Namely, an input screen utilized for the user to input the startup password is displayed on the display unit 1H. The user inputs the startup password from the input device 1I. The controller 1 judges whether the inputted password is valid or not (S3). When judging that the inputted password is valid, the controller 1 starts the communications by establishing the network on the physical layer (S5). Namely, the power line network utilizing the power line 5 is established.

Subsequently, the controller 1 confirms the devices existing within the power line network by broadcasting within the domain (S6). Then, the controller 1 detects the devices existing within the domain, then lists up the devices and displays the device list on the display unit 1H (S7).

The user judges whether to change the setting of the permission or non-permission of the usage (the power-on of the device body 2B) of each of the devices given in the list displayed on the display unit 1H (S8). In the case of changing the setting, the user selects the devices to be set as the usage target devices from the displayed list and sets the selected devices (S9). Hereat, the controller 1 transmits a setting instruction for instructing all the devices selected by the user to set in a security mode (S10). To be specific, the respective devices set as the usage target devices by the controller 1 are set in such a security mode that the power-on is not conducted without permission.

The controller 1 registers the RAM 1D with only the devices each sending the notification of the setting permission about the setting instruction as the usage target devices together with the identifications IDs (S11). At this time, the controller 1 does not register the device that does not notify of the setting permission as the usage target device by displaying an error. In S3, if the startup password is not set, the controller 1 shifts to the process of prompting the user to set the startup password (S4).

Thus, the controller 1 can register the information as to whether the usage can be permitted or not for every device in linkage with the respective devices existing on the power line network. Further, the startup password is employed when starting up the controller 1, the use by an unspecified person can be restricted.

<<Device>>

Figure 7:
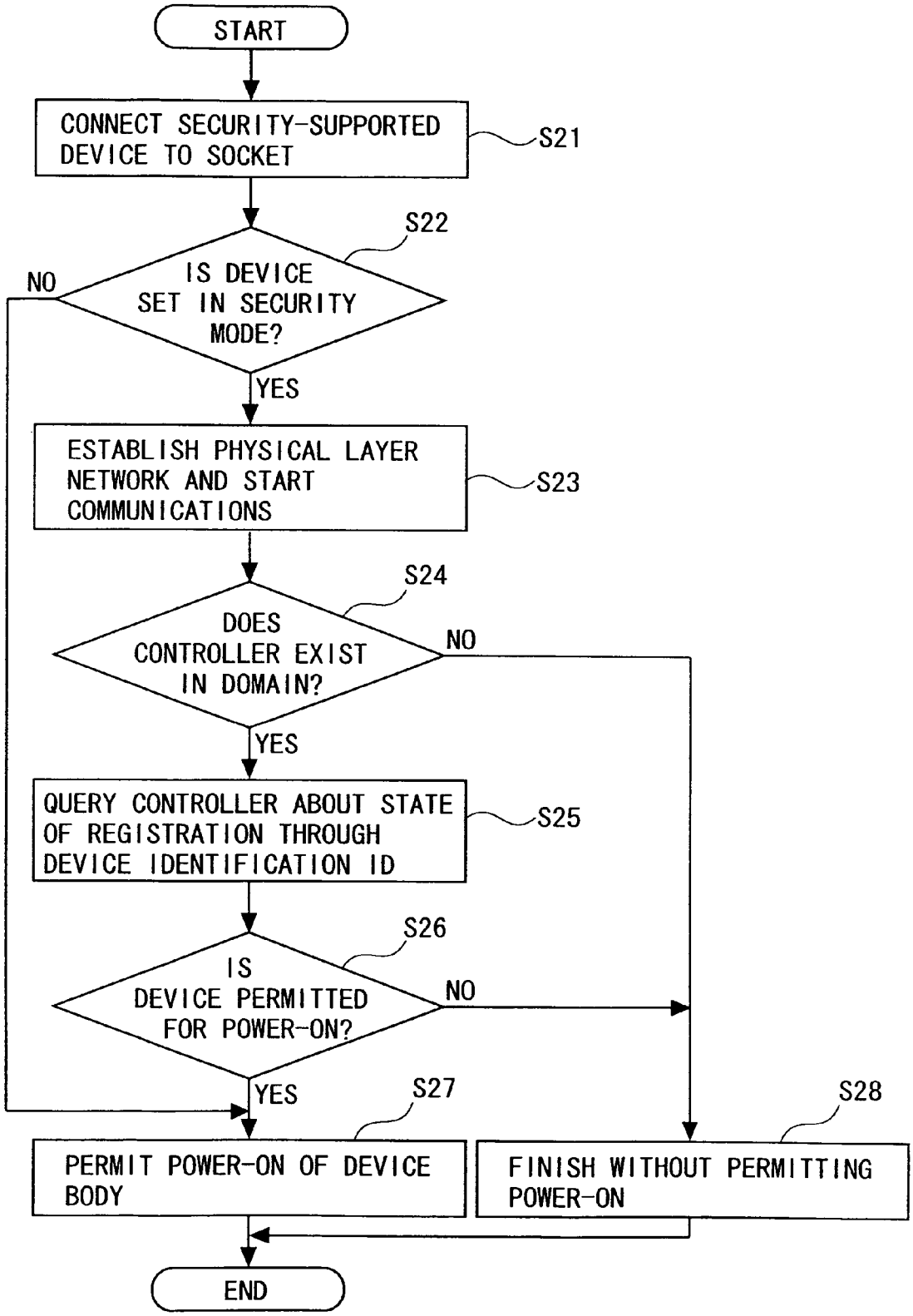
FIG. 7 is a flowchart showing the process executed on the device.

Next, a process executed mainly on the device 2 will be described with reference to FIG. 7. FIG. 7 is a flowchart showing the process executed on the device 2. This process is assumed to be a process executed after the device 2 has received a setting instruction of shifting to the security mode from the controller 1 and stored the RAM 2D with such a setting that the device 2 itself is in the security mode. Herein, the description will be made by taking up the device 2, however, the other devices 3 and 4 execute the similar process.

To start with, the user connects the device 2 to the plug socket (S21). Hereat, the power source 2G of the device 2 is connected to the power line 5, whereby only the communication/power source control unit 2A becomes the electrified state. Subsequently, the device 2 judges whether the device 2 itself is in the security mode or not (S22). Namely, the information processing device 2C judges whether or not the setting of being in the security mode is done in the RAM 2D. Herein, it is judged whether the device 2 is in a state of enabling the power-on by itself without restriction. At this time, if the device 2 is judged to be in the security mode, the device 2 starts the communications by establishing the network on the physical layer (S23). Namely, the power line network utilizing the power line 5 is established, and there occurs a state enabling the communications with the controller 1. Further, if the device 2 is judged not to be in the security mode, the power-on of the device body 2B is directly allowed.

Subsequently, the device 2 checks whether the controller 1 exists within the domain (on the power line network) or not (S24). For instance, the device 2 confirms the existence of the controller 1 by knowing whether or not a response is given from the controller 1 after broadcasting across the power line network. If the controller 1 exists, the device 2 queries the controller 1 about a state of registration by sending the notification containing the device identification ID (S25). Namely, on the side of the controller 1, it is judged whether or not the device having this identification ID is a device permitted to conduct the power-on. Hereat, the controller 1 notifies the device of information containing the permission or non-permission of the power-on. The device judges based on this notification whether the power-on is permitted or not (S26). If permitted, the information processing device 2C permits the device body 2B to effect the power-on (S27). More specifically, the information processing device 2C electrifies the device body 2B by executing the control of switching ON the switch 2H. Whereas if not permitted, the information processing device 2C finishes the process without permitting the power-on of the device body 2B (S28). Through this operation, when the controller exists on the power line network and permits the power-on, the power-on of the device is conducted. Note that if no response is given from the controller 1 within a predetermined period of time, the power-on may not be permitted in the judgment in S26.

<<Control of Usage Permissibility of Device>>

Figure 8:
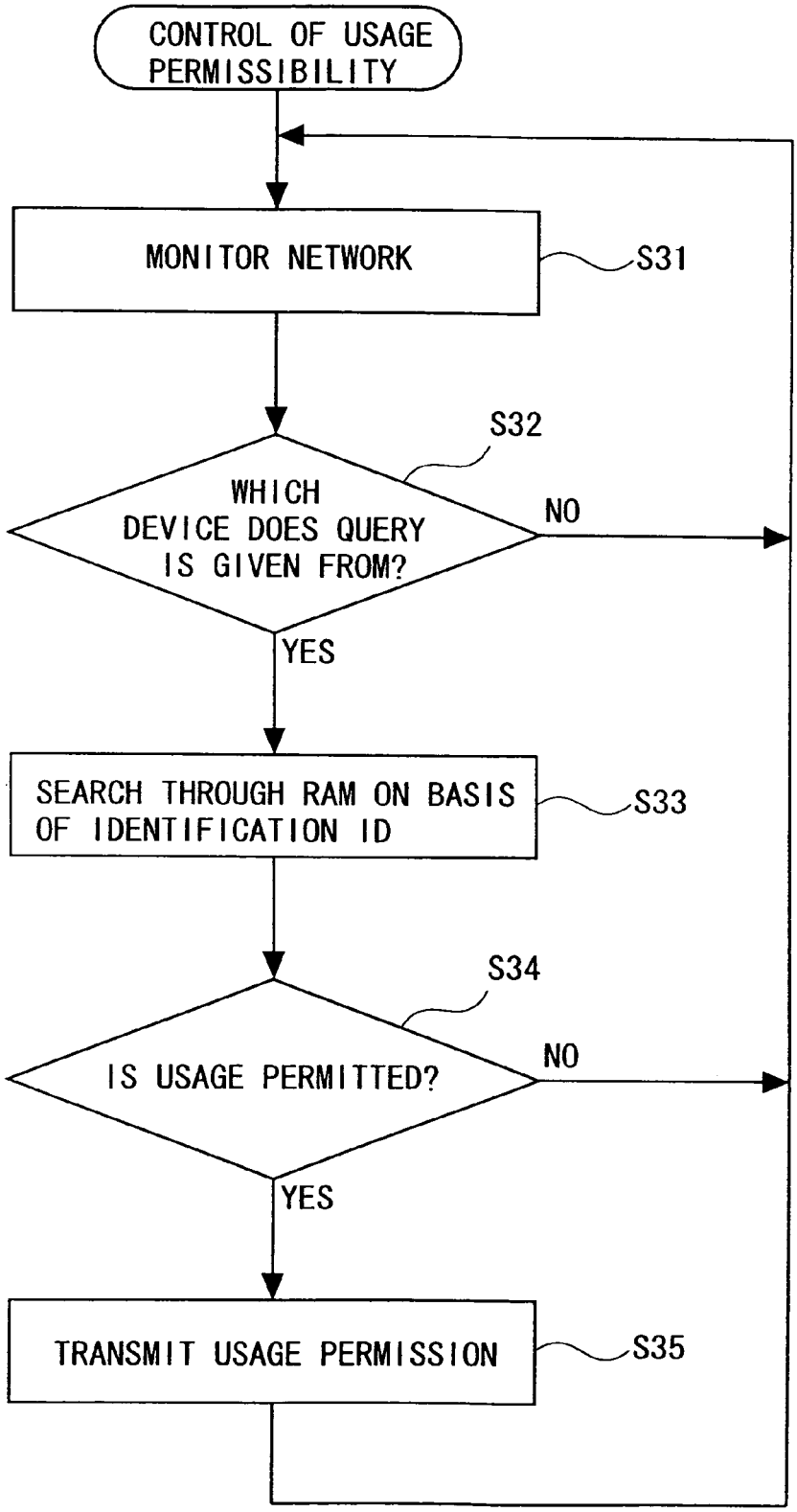
FIG. 8 is a flowchart showing a process in which the controller controls usage permissibility of each device.

Given next is an explanation of how the controller 1 controls the usage permissibility of each device. FIG. 8 is a flowchart showing a process in which the controller 1 controls the usage permissibility of each device. This process is one example of the process executed by the controller 1 in response to the query about the state of registration that is given from each device.

At first, the controller 1 monitors the network (S31). Herein, the communication signal processing device 1F of the controller 1 monitors the signals transmitted and received across the network.

Subsequently, the controller 1 judges whether any queries about the state of registration from any devices is given (S32). Herein, the communication signal processing device IF of the controller 1 judges whether or not the received signal corresponds to the from-the-device query about the state of registration. Namely, it is judged whether or not the received signal is the notification containing the identification ID. If the query is given from any one of the devices, the controller 1 searches through the RAM 1D on the basis of the identification ID contained in the notification (S33). While on the other hand, if the query is sent from none of the devices, the controller 1 continues to monitor the network.

Subsequently, the controller 1 judges whether the usage of the query sender device is permitted or not (S34). Namely, the information processing device 1C judges whether or not the device specified by the identification ID is registered as the usage target device on the RAM 1D. Herein, if the usage thereof is permitted, the notification indicating the usage permission is transmitted to the device (S35).

Whereas if the usage is not permitted, the controller 1 returns to S31 and monitors again the network. At this time, the controller 1 may send notification indicating non-permission of the usage to the query sender device.

Thus, the controller 1 can perform the control of giving the permission or non-permission of the power-on of the device body of each of the devices existing on the power line network. Namely, the controller 1 is capable of restricting the freehand usage of the individual devices existing on the power line network. According to the present embodiment, when the fixed condition is met in linkage with the controller, the device becomes the usable state by executing the power-on of the device body. Namely, the device can be used upon the power-on when the controller 1 exists on the power line network and permits the power-on.

Accordingly, even if the device might be stolen, the power source can not be switched ON without restraint, so that the unauthorized use of the stolen device can be prevented.

Further, according to the present embodiment, the controller 1 can function by the operation that is as simple as connecting to the plug socket and can be excluded from on the power line network by only the operation of pulling the plug out of the socket. Namely, the user can control the power-on of each device by the simple operation of putting the plug of the controller 1 into the socket and pulling the plug therefrom.

<Modified Example>

The embodiment is based on the assumption of the case in which the information devices are connected on to the power line network. The embodiment of the invention is not, however, limited to the kind of devices to be connected. For example,a case of connecting home electrical appliances is also available.

Figure 9:
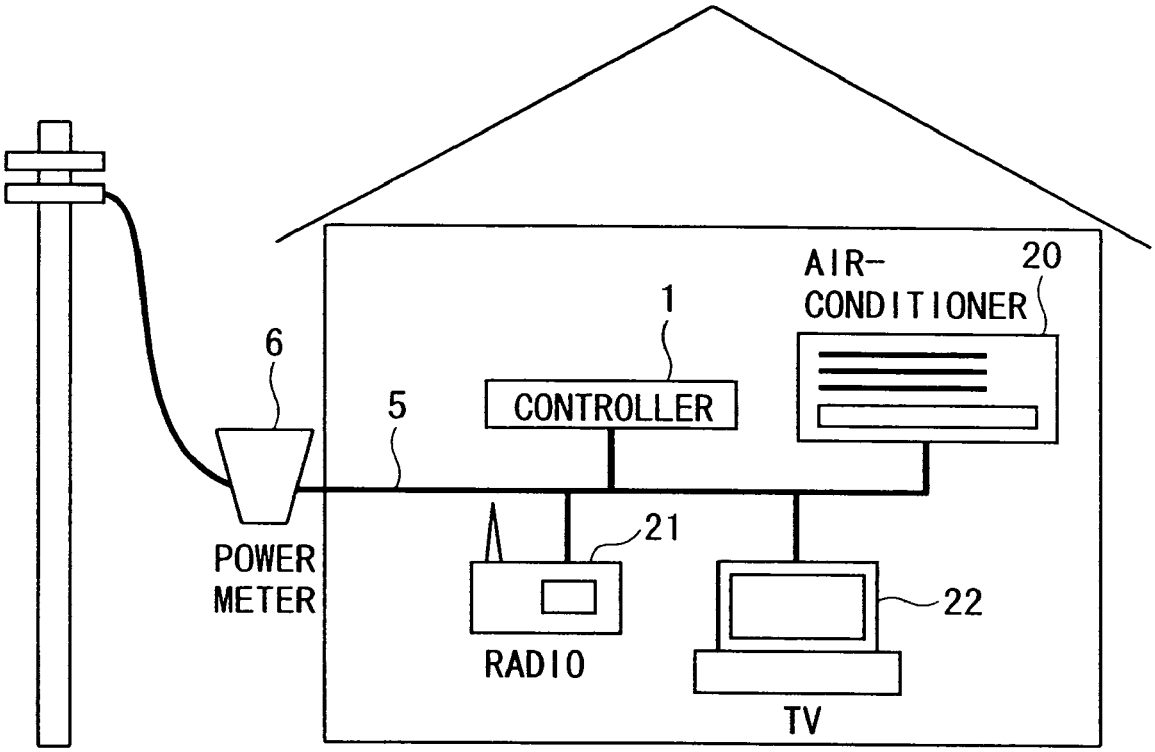
FIG. 9 is a view showing a configuration in a case where the present invention is applied to home electrical applications installed in the home.

FIG. 9 is a view showing a configuration in a case where the present invention is applied to the home electrical applications installed in the home. FIG. 9 shows an example, wherein an air-conditioner 20, a radio set 21 and a TV set 22 are connected as the home electrical appliances to the power line network via plug sockets. In this case, a random number etc. distributed from the controller may be used as an identification ID specifying the device.

INDUSTRIAL APPLICABILITY

The present invention can be applied to the network built up by utilizing the power line and to the electrical appliances, the information devices, etc. on this type of network.

What is claimed is:

1. A control apparatus comprising:

a communication unit notifying each of devices existing under control that said device is a control target device to be controlled as to power-on permissibility;

a registration unit registering said device as said control target device to be controlled as to the power-on permissibility when accepting a response to the notification;

a power source control unit controlling the power-on permissibility of said control target device on the basis of information registered on said registration unit; and a group setting unit setting any one or more devices in any one or more control target device groups in a plurality of control target device groups, wherein said power source control unit controls the power-on permissibility for every control target device group with respect to said device set in each of said control target device groups.

2. The control apparatus according to claim 1, further comprising an input unit accepting a setting of the power-on permissibility of said device.

3. A device comprising:

a setting unit setting as to whether or not said device itself is under control of a control apparatus on a network;

a control unit querying said control apparatus about a state of registration of said device itself when the setting of being under the control is done by said setting unit; and a switch unit connecting a body unit of said device to a power source in a disconnectable manner, wherein said control unit instructs said switch unit to conduct the power-on of the body unit of said device when a response to the query contains information indicating permission of the power-on.

4. The device according to claim 3, wherein said control unit does not instruct said switch unit to conduct the power-on of the body unit of said device when said control apparatus does not exist on the network.

5. A power source control method for a device, comprising:

a communication step of notifying each of devices existing under control that said device is a control target device to be controlled as to power-on permissibility;

a registration step of registering said device as said control target device to be controlled as to the power-on permissibility when accepting a response to the notification;

a power source control step of controlling the power-on permissibility of said control target device on the basis of information registered on said registration unit; and a group setting step of setting any one or more devices in any one or more control target device groups in a plurality of control target device groups, wherein said power source control step includes controlling the power-on permissibility for every control target device group with respect to said device set in each of said control target device groups.

6. The power source control method for a device according to claim 5, further comprising an input step of accepting a setting of the power-on permissibility of said device.

7. A power source control method for a device having a body unit connected to a power source in a disconnectable manner, comprising:

a setting step of setting as to whether or not said device itself is under control of a control apparatus on a network; and a control step of querying a control apparatus about a state of registration of said device itself when the setting of being under the control is done by a setting unit.

8. The power source control method for a device according to claim 7, wherein said control step includes conducting the power-on of the body unit of said device when a response to the query contains information indicating permission of the power-on.

9. The power source control method for a device according to claim 7, wherein said control step includes conducting none of the power-on of the body unit of said device when said control apparatus does not exist on the network.

10. A storage medium readable by an apparatus, tangibly embodying a power source control program executable by the apparatus to perform method steps comprising:

a communication step of notifying each of devices existing under control that said device is a control target device to be controlled as to power-on permissibility;

a registration step of registering said device as said control target device to be controlled as to the power-on permissibility when accepting a response to the notification;

a power source control step of controlling the power-on permissibility of said control target device on the basis of information registered on said registration unit;

a group setting step of setting any one or more devices in any one or more control target device groups in a plurality of control target device groups; and a step of controlling the power-on permissibility for every control target device group with respect to said device set in each of said control target device groups.

11. The storage medium readable by the apparatus, tangibly embodying the power source control program executable by the apparatus according to claim 10, further comprising an input step of accepting a setting of the power-on permissibility of said device.

12. A storage medium readable by a device, tangibly embodying a power source control program executable by the device, for making the device control a power source of the device having a body unit connected to a power source in a disconnectable manner to perform method steps comprising:

a setting step of setting as to whether or not said device itself is under control of a control apparatus on a network; and a control step of querying a control apparatus about a state of registration of said device itself when the setting of being under the control is done by a setting unit.

13. The storage medium readable by the device, tangibly embodying the power source control program executable by the device according to claim 12, wherein said device is made to execute a step of conducting the power-on of the body unit of said device when a response to the query contains information indicating permission of the power-on.

14. The storage medium readable by the device, tangibly embodying the power source control program executable by the device according to claim 12, wherein said device is made to execute a step of conducting none of the power-on of the body unit of said device when said control apparatus does not exist on the network.

* * * * *